US005078130A

United States Patent [19]

Van Oosten et al.

[11] Patent Number: 5,078,130

[45] Date of Patent: Jan. 7, 1992

[54] PERSONNEL HEADGEAR ENABLING FREE BREATHING OF AMBIENT AIR OR SELECTIVE BREATHING FROM VARIOUS SOURCES

[75] Inventors: Lucien F. A. Van Oosten, Arcadia; Stanley A. Bonner, San Dimas, both of Calif.

[73] Assignee: Gentex Corporation, Pomona, Calif.

[21] Appl. No.: 219,302

[22] Filed: Jul. 14, 1988

[51] Int. Cl.[5] ..... A62B 17/04

[52] U.S. Cl. ..... 128/201.24; 128/201.25; 128/201.28

[58] Field of Search ..... 128/201.24, 201.25, 128/201.28, 202.26, 205.24, 205.28

[56] References Cited

U.S. PATENT DOCUMENTS

| | | | |
|---|---|---|---|
| 645,281 | 3/1900 | Vajen | 128/201.28 |
| 1,215,327 | 2/1917 | Ackerman | 128/201.24 |
| 1,978,994 | 10/1934 | Fortunato | 128/201.25 |
| 2,048,059 | 7/1936 | De Boudemange | 128/201.25 |
| 3,149,632 | 9/1964 | Colley | 128/201.24 |
| 3,433,222 | 3/1969 | Pinto | 128/201.24 |
| 3,577,988 | 5/1971 | Jones | 128/201.25 |
| 3,739,774 | 6/1973 | Gregory | 128/201.28 |
| 3,910,269 | 10/1975 | Ansite et al. | 128/201.24 |
| 4,155,361 | 5/1979 | Mascher | 128/202.26 |
| 4,157,091 | 6/1979 | Pampuch | 128/202.26 |
| 4,352,353 | 10/1982 | Bolton et al. | 128/201.24 |

*Primary Examiner*—Edgar S. Burr
*Assistant Examiner*—Aaron J. Lewis
*Attorney, Agent, or Firm*—Donald D. Mon

[57] ABSTRACT

Protective headgear with a face shield which can be tilted up out of the way, and which when tilted downwardly can be placed in a standby position enabling free breathing of ambient air through a gap between a helmet and the face shield, and can be pressed back to create a seal to require breathing from a controlled source. A selector is mounted on the face shield to enable the wearer to make a quick and effective selection of breathing modes. A face seal can be mounted to the inside of the face shield to form an oro-nasal dam around the nose and mouth of the wearer to provide another seal, and a reduced plenum volume.

14 Claims, 2 Drawing Sheets

FIG. 5
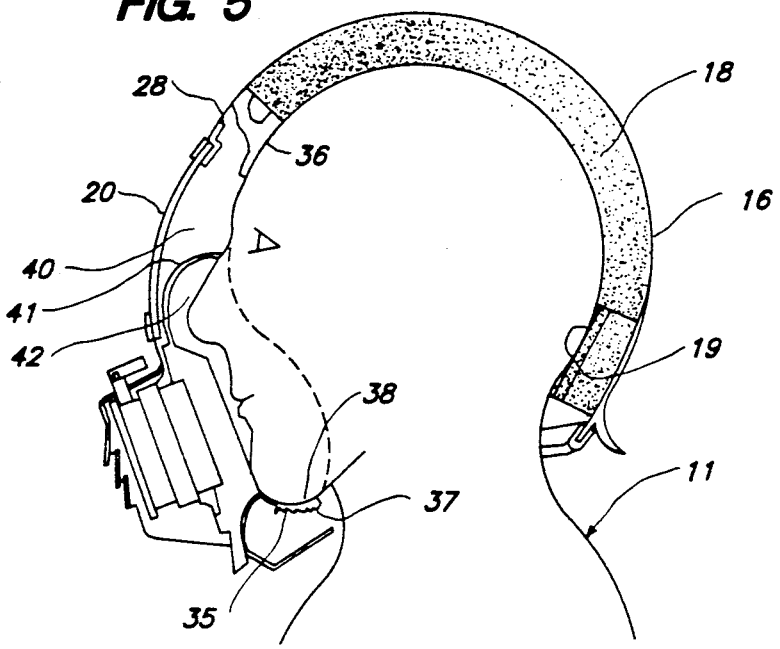
FIG. 6
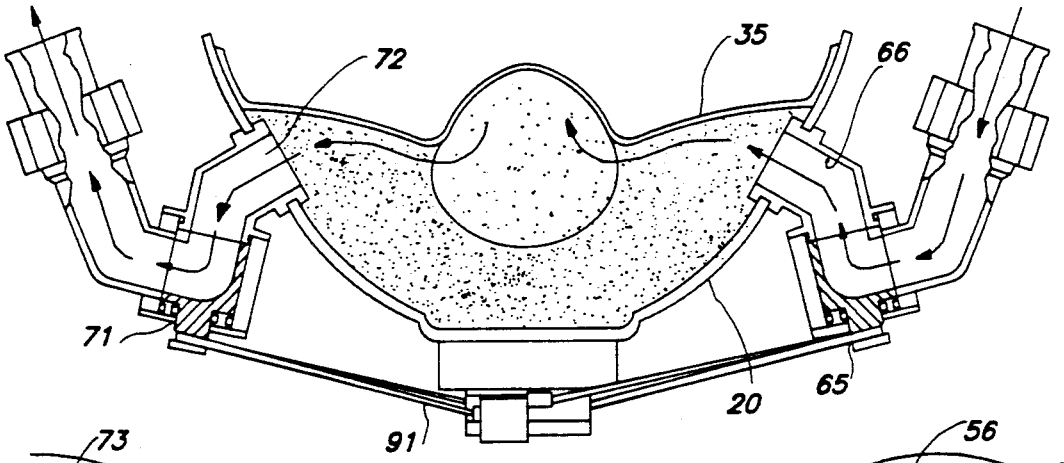
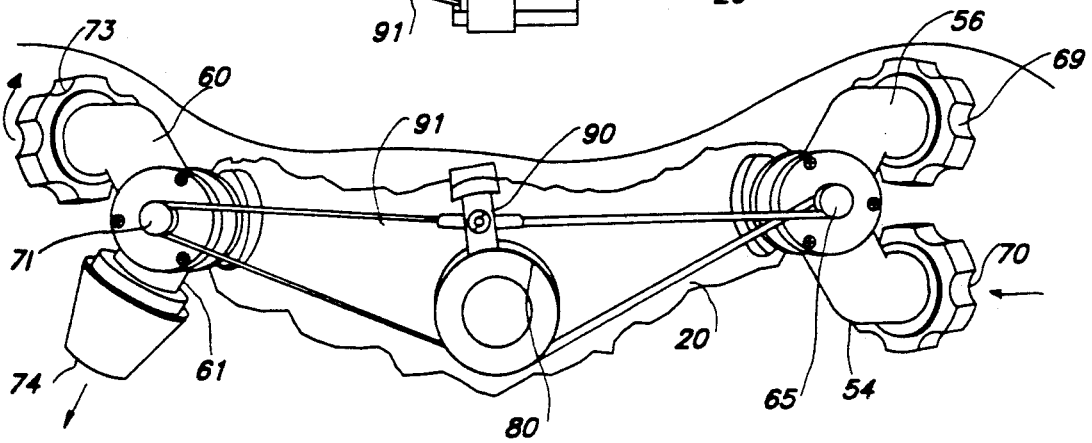
FIG. 7

PERSONNEL HEADGEAR ENABLING FREE BREATHING OF AMBIENT AIR OR SELECTIVE BREATHING FROM VARIOUS SOURCES

FIELD OF THE INVENTION

This invention relates to protective headgear which enables its wearer selectively freely to breathe ambient air, or to breathe air from other sources to the protective exclusion of hazardous atmospheres.

BACKGROUND OF THE INVENTION

Firefighters and other personnel who must enter hazardous atmospheres are routinely provided with breathing apparatus. Such apparatus regularly includes some kind of mask or headgear which supplies the wearer with breathing air to the exclusion of the hazardous atmosphere.

This class of protective equipment is generally accepted, especially when it is used for breathing purposes during relatively brief periods of exertion. A firefighter who arrives at an incident, puts on the equipment, and works for a short time with it does endure a significant but still acceptable stress. Within a reasonably short period of time he will be out of the situation, either because it has been resolved, or because he must be relieved.

This degree of stress and exposure is respective to relatively routine events such as structural fires without involvement of severely toxic or poisonous gases, where the personnel can routinely approach the event, put on the apparatus, do the work, and then leave. In such events the stress is merely that of breathing filtered air, or of breathing air supplied from a tank. This is not necessarily a minor matter. Restrictions on breathing inherently tire a person, and this expenditure of energy reduces his capacity to perform the external services which called for his participation. However for many, even for most, organizations such as city fire departments in primarily residential cities, the existing situation is tolerable, and the equipment need be no more than tanks of breathing air and suitable face masks.

There are, however, more stringent situations, where the person must be clothed and on stand-by or be active for long periods of time and in which he must be nearly instantly able to exclude a hazardous atmosphere. Such situations can be found in firefighting where the generation of noxious gases is a risk but not yet an event, or in stand-by operations for ready crews such as for airport firefighters or participants in chemical warfare situations. For these men it is necessary to provide the greatest possible flexibility of breathing techniques, together with readily manipulable means to secure the man's safety and to select the most advantageous breathing mode for the moment. For example, he should be able to wear the full gear while being equipped in such a way that he can breathe ambient air, but on a moment's notice be able to change to a selected breathing mode to the exclusion of the ambient.

It is an object of this invention to provide breathing headgear which enables its wearer to be in various conditions of readiness, and quickly to select among various breathing modes, all for enabling him to remain ready or to be in action with least appropriate breathing stress at all times.

BRIEF DESCRIPTION OF THE INVENTION

Headgear according to this invention includes a helmet shell which encompasses the top, sides and back of the head, and which can but need not necessarily be adapted to make a gas seal either with the neck or with a garment that extends below the neck, such as a gas-protective suit. The helmet has a forwardly-facing face opening.

A transparent face shield is slidably and pivotally mounted to the helmet. It can be pivoted upwardly to stand above the face opening, and pivoted downwardly to stand in front of it. In its lowered position it can be moved forwardly to leave a gap between the face shield and the helmet, which enables free breathing of ambient air through the gap in that arrangement. Of course, free breathing of ambient air is also enabled when the face shield is in its raised position.

It is a feature of this invention that the face shield, when in its lowered position, can be pressed into contact with the helmet where it or may not form a gas tight seal. In addition, the face shield carries a face seal that seals around the face to make a reliable primary seal. Thus, the face shield when in its lowered position, can be in a ready status with the primary seal spaced from the face, enabling free breathing of ambient air, and the wearer can almost instantly be sealed from ambient air merely by pressing the face shield against the helmet and simultaneously pressing the face seal against his face.

A wearer who perceives no immediate need for facial isolation from the atmosphere can tilt the faceplate upwardly and be free of its nuisance. When he perceives a sensibly imminent need, he can pull the face shield down and move it forwardly, still continuing to breathe ambient air through the gap between the face shield and the helmet without breathing stress. When isolation from the ambient is needed, the face shield need only be pressed back so the face seal seals with the face, and then breathing gases are supplied to him. The stress of breathing from a controlled source is thereby reduced to its minimum period of time, and the wearer is always able readily to change from ambient to confined breathing and vice versa merely by moving the face shield toward or away from the face, whether he tilts the shield up or not.

The face shield is provided with inhalation and exhalation conduitry. Inhalation mode selector means is provided selectively to admit air—either filtered or unfiltered—from the atmosphere, or to admit air from a breathing gas source such as a blower or a pressurized tank. Exhalation mode selector means is provided selectively to discharge air from the headgear either to the atmosphere or to a breathing gas source for recycling.

According to a preferred but optional feature of this invention, an oro-nasal dam is also carried by the face shield so as to move with it. The inhalation and exhalation conduitry is connected to the oro-nasal dam. The dam fits closely to the wearer's face (although not necessarily with an air-tight fit) when the face seal fits against the face, so the breathing circuit is through the dam. The dam is spaced from the wearer's face, as is the face seal, when the face shield is moved forwardly with the face shield so it does not impede the breathing of ambient air through the gap between the face shield and the helmet.

The dam, because it occupies less than the total volume between the face shield and the helmet, reduces the latent air volume within which breathing air is supplied and withdrawn by the wearer. Reduction of this latent volume greatly facilitates the maintenance of a proper breathing mixture for him. Persons skilled in this art are well aware that large latent volumes can permit carbon dioxide buildup in relatively short periods of time. Reduction of the latent volume reduces this risk significantly.

In addition, the dam provides a secondary line of protection for the lungs against noxious gases which might somehow have bypassed the face seal. While such stray gases are sometimes merely undesirable, it is advantageous to exclude them from the wearer's respiratory system as much as possible.

According to a preferred but optional feature of this invention, the selector means is carried on the face shield itself, so as readily to be locatable, and manipulable by the wearer who merely reaches forward to the front of the face shield to find this means. Even in dense smoky atmospheres, this ready availability of the selector means is at once an assurance to the wearer, and a safety feature in the event of an immediate need.

The above arrangements enable a man to be on long term stand-by without breathing stress, while still having very quick availability of full safety provisions. Breathing stress from breathing gases from sources other than ambient are eliminated except when it is absolutely necessary to endure them.

The above and other features of this invention will be fully understood from the following detailed description and the accompanying drawings, in which:

BRIEF DESCRIPTION OF THE DRAWINGS

FIG. 5 is a semi-schematic cutaway view showing a face mask and oro-nasal dam attached to the face shield, against the wearer's face;

FIG. 6 is a semi-schematic cutaway cross-section view showing selector valve means; and FIG. 7 is a front view showing conduitry connections and selector controls.

DETAILED DESCRIPTION OF THE INVENTION

Figure 1:
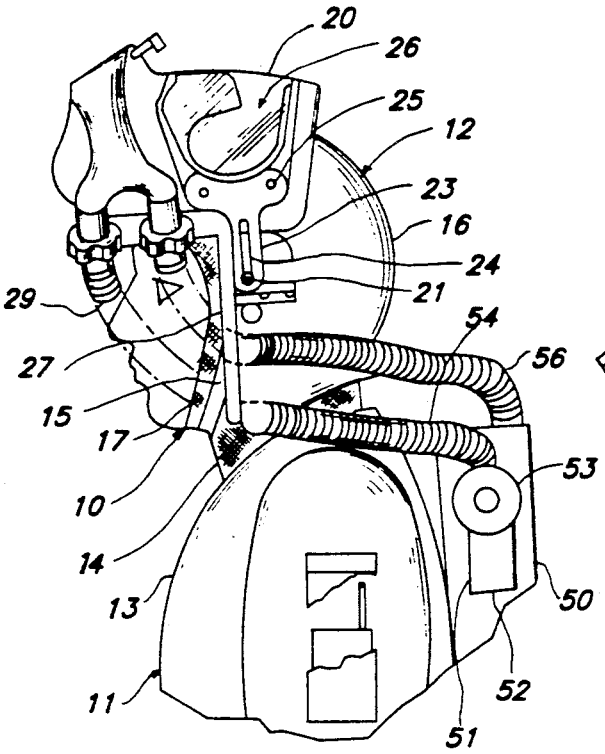
FIG. 1 is a side view of the presently-preferred embodiment of headgear according to the invention, with the face shield in its raised position.

The head 10 of a wearer 11 of headgear 12 according to the invention is shown in FIG. 1. He is shown wearing a conventional protective suit 13 with a conventional neck cover 14 and head cover 15.

The headgear includes a helmet 16 (sometimes called a "backshell") held to the head by a suitable chin strap 17. As best shown in FIG. 5, a shock-absorbing headliner 18 can be fitted between the head cover and the helmet. At the nape of the neck, a bone microphone 19 can be included if desired.

Face shield 20 is pivotally mounted to both sides of the helmet. The left and right side mounting means 21 to the shield are mirror images of one another. Each includes a headed hinge pin 22 and an arm 23 with a slot 24. The arm is pivotable around the pin, and can move axially relative to the pin. Axial movement is enabled by the slot.

Face shield 20 is attached to the arm by fasteners 25. The face shield includes a transparent portion 26 which is in the line of vision when the face shield is in its lowered position (FIGS. 2-5).

The helmet has a front opening 27 bounded by a peripheral edge 28. Either that edge or an area surrounding it is shaped to make a close fit with either the peripheral edge 29 of the face shield, or an area or seal on or adjacent to it.

The raised position of the face shield is shown in FIG. 1. In this position the face shield is entirely out of the way, and the wearer can breathe the ambient air freely. His vision is not impeded by the face shield.

Figure 2:
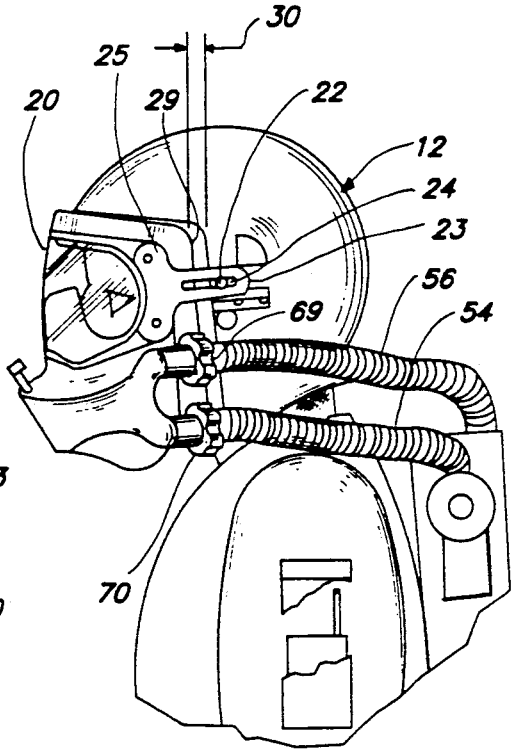
FIG. 2 is a similar side view with the face shield in its lowered and forward position which enables free ambient breathing.

The face shield is shown in FIG. 2 in the forward one of its two lowered positions. It has been pivoted around the hinge pin, and moved forwardly by sliding the arm along the hinge pin, the hinge pin moving in the slot. The face shield is in front of the wearer, through which he must look. However, the wearer can freely breathe ambient air at this time, because a generous gap 30 remains between the face shield and the helmet through which there is adequate ventilation to permit free circulation of ambient air to him. Thus the headgear is in a condition of instant readiness, but the wearer is spared the stress of breathing from a restricted source and he has a good view of his surroundings.

Figure 3:
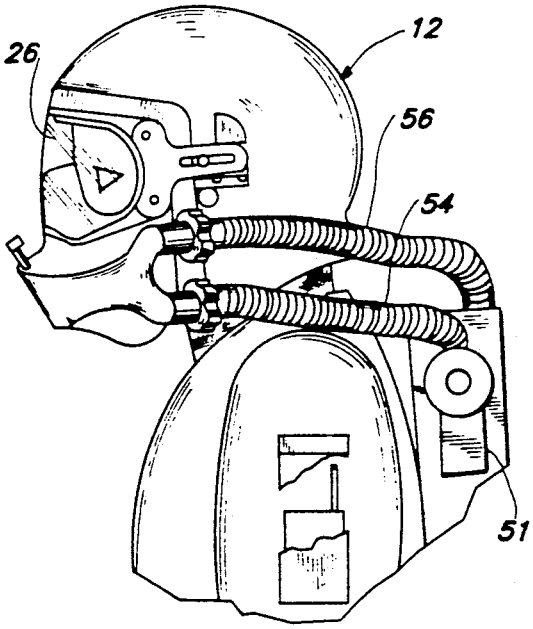
FIG. 3 is a similar side view with the face shield in its lowered and rear position, sealed against the helmet, with breathing gases available from a blown ambient supply or from some supply other than ambient.
Figure 4:
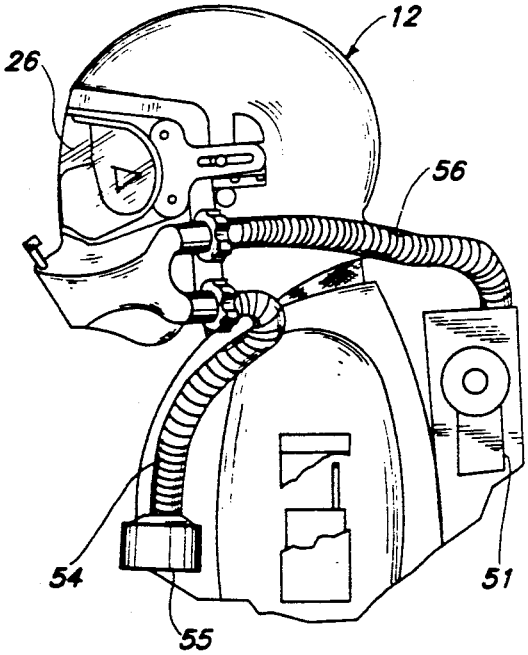
FIG. 4 is a side view similar to FIG. 3, for optional breathing of filtered ambient air, not blown, or from some supply other than ambient.

FIGS. 3 and 4 show the headgear in its full protective position. The face shield while in its lowered position has been pressed back firmly against the helmet. While it is possible to rely on the abutment of the face shield and the helmet to isolate the wearer from ambient, this is not generally acceptable because of the inherent difficulty of making a sufficient seal all the way around the helmet opening.

Instead, according to this invention a fully peripheral face seal 35 is bonded to the face shield so as to move toward and away from the face with the face shield. As best shown in FIG. 5, it has a flange 36 that extends across the forehead, and a flange 37 that fits snugly under the chin. It forms a cup-like recess 38 in which the chin fits.

Flexible flanges (not shown) interconnect flanges 36 and 37 on each side of the face, thereby to form a frame-like resiliently deformable structure which when pressed against the face deflects to form a reliable gas seal around the eyes, nose and mouth. Because these flanges are continuously bonded to the face shield, they provide an isolation from ambient. The face seal makes its sealing fit against the face before the face shield fits against the helmet, and when the shield is pressed firmly in place, the seal will have fully conformed to the skin. The face seal is soft and conforming seal which thus protects the wearer's respiratory system.

There is a substantial region 40 inside the face shield. A problem with such substantial regions is that conventional breathing systems cannot assure that the breathing gases in such large volumes remain suitable for continuous breathing. The region exposed to the nostrils is relied on for both inspiration of gases and exhalation of gases. In large volumes, especially those with potentially stagnant regions, the composition of the gases can degrade for breathing purposes. Especially there is a significant risk of carbon dioxide build-up.

After a dozen or so breaths of air, a mixture with too high a carbon dioxide concentration can be generated. The user can become dizzy and disoriented.

For this reason an oro-nasal dam 41 is provided, either as a molded portion of the face seal, or as a separate part bonded to the face shield. Its purpose is to provide a lesser latent volume as a plenum 42 from which the user breathes and into which he exhales. Then there is a lesser latent volume in which undesired concentrations of gases can build up. A lesser volume more readily swept by the quantity of gas required for breathing.

The oro-nasal dam closely resembles a conventional aviator's mask of the general type shown in Wilcox U.S. Pat. No. 4,677,977, which is incorporated herein by reference. When pressed against the face, it makes a peripheral seal over the top of the nose along the sides of the face and beneath the mouth, thereby encircling the nostrils and mouth.

The oro-nasal dam is not primarily designed as a gas seal in the sense of protecting the respiratory system from ambient or any other gases, although it may in fact provide a useful secondary seal. It is principally intended to create a lesser plenum, even though this plenum may be "leaky". Leakage into the larger region inside the face shield does not deleteriously affect this function. The lesser plenum is readily swept by the volume of gases used for the breathing function.

The principal gas seal is at the face seal. It will be designed to meet the standards of the system. Any seal made by the face shield against the helmet and by the face seal (sometimes called an "oro-nasal dam") against the face, is cumulative and helpful but not required.

Should further assurance be needed, the regions inside the oro-nasal dam or between the face shield and the helmet can be operated at a pressure higher than ambient, so that any flow is outward from the headgear.

It is important to the wearer not only that he be protected from noxious gases, but that he be provided with suitable air for breathing. In general emergency work, it may very well be the situation that full protection for the head and face is required, but at the same time the ambient air is properly breathable. At other times, most gaseous constituents of the ambient air may be properly breathable, except for entrained particulates or for some readily removable pollutants. Then filtered ambient air is suitable.

There are breathing gas supplies, also. Blower supplied air, exhausted to atmosphere, may many times be suitable and even preferred. This requires no more than gas tanks and suitable regulators. This is useful when the duration is not too long, because if it is too long, the weight of the tanks becomes a limiting factor for the wearer. Chemical warfare situations are in this class. The term "blower supplied" is intended to include gas from pressurized tanks.

There are other events, usually of longer duration, where the exhalation of any gases from the system may not be desirable. This in effect requires a closed circuit breathing system, in which the air exhaled by the wearer is recirculated and reconstituted to provide a new and breathable atmosphere. Reactors to consume excess carbon dioxide and cylinders to provide additional oxygen are well-known expedients for this purpose. Chemical warfare situations are in this class, also.

Headgear according to this invention is adaptable to provide all of the above functions. In FIG. 1, a backpack 50 is shown which houses a blower 51 having an inlet 52 and an outlet 53. An ambient air conduit 54 is connectible to outlet 52, so as to provide blown ambient air to the helmet. This arrangement is shown in FIG. 3.

Alternately, as shown in FIG. 4, conduit 54 can be released from the blower and provide ambient air directly, not from the blower, preferably but not necessarily through a filter 55. The filter may include a chemical reactor if desired. A filter may, of course, be incorporated in blower 51. The principal difference between FIGS. 3 and 4 is that in FIG. 4 the ambient air is not blown, whereas in FIG. 3 it is blown.

FIGS. 3 and 4 also show that a rebreather supply conduit 56 extends from the rebreather unit to the headgear.

Conduits 54 and 56 are supply conduits used to supply breathing gases to the headgear when the face shield is sealed against the helmet.

The exhalation side of the system is best shown in FIG. 7. A conduit 60 returns gases to the rebreather unit, while conduit 61 discharges to atmosphere.

There is a necessary selection between these conduits in order to enable the wearer to select the desired operating mode. It must be simple because of the urgent situations in which the system is used. This invention requires only two two-way selector valves, which can readily be set by a single control lever.

Inhalation selector valve 65 has a common outlet port 66 discharging into plenum 42. It has inlet ports 69, 70 respective to conduits 54 and 56, so that inhalation air can be supplied from the rebreather unit, from the blower, or from ambient.

On the exhalation side of plenum 42, exhalation selector valve 71 has a common inlet 72 from the plenum and selectible outlet ports 73, 74 leading respectively to the atmosphere or to the rebreather unit. These are all of the controls needed for the full range of functions available from this system.

The conduits are flexible hoses, readily flexed to permit the movements of the face shield, and positioned so as not to impede the wearer at any time.

A selector 80 is mounted to the face shield at its central front region. For simplicity, the wearer should not have to make any involved setting. He need only to move a lever 90 to one side or the other. One control setting is to admit or to exclude ambient air, and this in effect means to select between conduits 54 and 56. Ambient air will never conveyed to the recirculation unit.

The other control setting is return to atmosphere or the the rebreather. Thus, the two rotary type selector valves will be concurrently adjusted by moving lever 90 to shift control loop 91 (a flexible cable) to set the two rotary valves.

Should blown air or its equivalent—a pressurized supply of fresh air from a tank be provided, it will be as the result of connection of conduit 54 to a respective source, or the the blower.

This invention thereby provides protective headgear for its wearer which is very forgiving of stress during rest or ready situations, but which is instantly available to protect him and provide him with an effective breathing mixture if needed.

This invention is not to be limited by the embodiments shown in the drawings and described in the description, which are given by way of example and not of limitation, but only in accordance with the scope of the appended claims.

I claim:

1. Protective headgear selectively to enable its wearer to breathe ambient air or supplied gases, comprising:

a helmet comprising a shell encompassing the top, sides, and back of the wearer's head and having a forwardly-facing face opening with a periphery;

an impermeable face shield with a transparent portion, said face shield having a peripheral edge engagable with the helmet adapted to close said face opening;

mounting means mounting said face shield to said helmet for pivoting to a raised position above said face opening, or to one of two fully lowered positions in front of it, a rearward one of said lowered positions causing said face shield to bear against the helmet, and the forward one to leave a substantial gap between them adequate to enable the wearer to breathe ambient air through it when said face shield is in its forward lowered position, in both of said lowered positions said transparent portion being in the line of sight of the wearer, said face shield being manually movable to the said positions.

2. Apparatus according to claim 1 in which ports to said face shield receive gases to be breathed by the wearer, and to exhaust exhaled gases to and from a region inside said face seal.

3. Apparatus according to claim 2 in which said ports comprise an inhalation inlet port and an exhalation outlet port to said region, each port connecting to a respective inhalation selector valve or to an exhalation selector valve, said inhalation selector valve being adapted to receive breathing gases from a plurality of inhalation sources, and said exhalation selector valve being adapted to discharge to a plurality of outlets.

4. Apparatus according to claim 3 in which one of said inhalation sources is the atmosphere, and the other is a rebreathing apparatus, and in which one of said exhalation outlets is the atmosphere, and the other is return to said rebreathing apparatus.

5. Apparatus according to claim 3 in which selector means is connected to both of said selector valves, said selector means being mounted centrally and externally on said face shield, and being adapted either to set both valves to close a circuit through the rebreather apparatus, or to connect both to atmosphere.

6. Apparatus according to claim 5 in which said selector valves are rotary valves interconnected by linkage connected to said selector means.

7. Apparatus according to claim 3 in which filter means is incorporated into the inhalation source.

8. Apparatus according to claim 1 in which a face seal is fixed to said face shield inside the perimeter of the face shield, having a peripheral flange so disposed and arranged as to be pressed against the wearer's face and make a fully peripheral resilient and conforming gas seal above the nose, down the sides of the face, and below the mouth, said seal being made no later than when the face shield bears against the helmet, in said rearward lowered position, said face seal being spaced from the wearer's face when the face shield is in said forward lowered position.

9. Apparatus according to claim 8 in which ports to said face shield receive gases to be breathed by the wearer, and to exhaust exhaled gases to and from a region inside said face seal.

10. Apparatus according to claim 9 in which said ports comprise an inhalation inlet port and an exhalation outlet port to said region, each port connecting to a respective inhalation selector valve or to an exhalation selector valve, said inhalation selector valve being adapted to receive breathing gases from a plurality of inhalation sources, and said exhalation selector valve being adapted to discharge to a plurality of outlets.

11. Apparatus according to claim 10 in which one of said inhalation sources is the atmosphere, and the other is a rebreathing apparatus, and in which one of said exhalation outlets is the atmosphere, and the other is return to said rebreathing apparatus.

12. Apparatus according to claim 10 in which selector means is connected to both of said selector valves, said selector means being mounted centrally and externally on said face shield, and being adapted either to set both valves to close a circuit through the rebreather apparatus, or to connect both to atmosphere.

13. Apparatus according to claim 12 in which said selector valves are rotary valves interconnected by linkage connected to said selector means.

14. Apparatus according to claim 3 in which filter means is incorporated into the inhalation source.

* * * * *